US005715556A

United States Patent [19]

Chung

[11] Patent Number: 5,715,556

[45] Date of Patent: Feb. 10, 1998

[54] TOOTHBRUSH WITH MANUALLY OPERATED BRISTLE DRIVEN MEANS

[76] Inventor: Chin-Fu Chung, No. 898, Min-Sheng St., Kuei-Jen Hsiang, Tainan Hsien, Taiwan

[21] Appl. No.: 769,489

[22] Filed: Dec. 18, 1996

[51] Int. Cl.[6] ..... A46B 13/08

[52] U.S. Cl. ..... 15/22.1; 15/28; 74/89.17

[58] Field of Search ..... 15/167.1, 22.1, 15/28, 25, 26, 29, 23; 74/89, 89.17

[56] References Cited

U.S. PATENT DOCUMENTS

| | | | |
|---|---|---|---|
| 1,561,062 | 11/1925 | Douglas | 15/26 |
| 3,115,652 | 12/1963 | Zerbee | 15/28 |
| 4,048,690 | 9/1977 | Wolfson | 15/22.1 |
| 4,827,550 | 5/1989 | Graham et al. | 15/28 |
| 5,068,939 | 12/1991 | Holland | 15/22.1 |
| 5,138,734 | 8/1992 | Chung | 15/28 |
| 5,276,932 | 1/1994 | Byrd | 15/22.1 |

*Primary Examiner*—Gary K. Graham
*Attorney, Agent, or Firm*—Varndell Legal Group

[57] ABSTRACT

A toothbrush including an elongated casing covered with a bottom cover and having rows of bristle holes at one end and three longitudinal sliding slots at an opposite end at different sides, a bristle holder and carrier frame assembly mounted inside the casing and holding bundles of bristles in the bristle holes of the casing, a chain gearing longitudinally mounted inside the casing and engaged with the bristle holder and carrier frame assembly, and three slides respectively mounted in the sliding slots of the casing and reciprocated to turn the bundles of bristles.

1 Claim, 7 Drawing Sheets

TOOTHBRUSH WITH MANUALLY OPERATED BRISTLE DRIVEN MEANS

BACKGROUND OF THE INVENTION

The present invention relates to toothbrushes, and relates more particularly to such a toothbrush which has manually operated bristle driven means that can be operated with fingers to turn the bundles of bristles when brushing the teeth.

In regular toothbrushes, the bristles are fixedly fastened into the head of the handle. This structure of toothbrush cannot effectively remove food bits from the teeth. Because the bristles are not movable when rubbing against the periphery of the teeth and the pitch between each two teeth, they cannot be inserted into the gaps in teeth without hurting the gum. In order to force the bristles into the gaps in the teeth, much effort shall be applied. However the gum tends to be damaged by the bristles which are not inserted into the gaps in the teeth. Brushing the teeth with much effort will damage the enamel of the teeth, and will cause the bristles to deform quickly. Therefore, the service life of regular toothbrushes is short. If to brush the teeth with a toothbrush of which the bristles are deformed, the teeth cannot be well cleaned. There are also known various motor-driven toothbrushes available on the market. These motor-driven toothbrushes can clean the teeth effectively, however the high revolving speed of the bundles of bristles tend to damage the gum. Furthermore, these motor-driven toothbrushes are expensive to manufacture.

SUMMARY OF THE INVENTION

The present invention has been accomplished under the circumstances in view. It is the main object of the present invention which can be manually operated to turn the bundles of bristles up and down when brushing the teeth. According to the preferred embodiment of the present invention, the toothbrush comprises an elongated casing covered with a bottom cover and having rows of bristle holes at one end and three longitudinal sliding slots at an opposite end at different sides, a bristle holder and carrier frame assembly mounted inside the casing and holding bundles of bristles in the bristle holes of the casing, a chain gearing longitudinally mounted inside the casing and engaged with the bristle holder and carrier frame assembly, and three slides respectively mounted in the sliding slots of the casing and reciprocated to turn the bundles of bristles.

DETAILED DESCRIPTION OF THE PREFERRED EMBODIMENT

Figure 1:
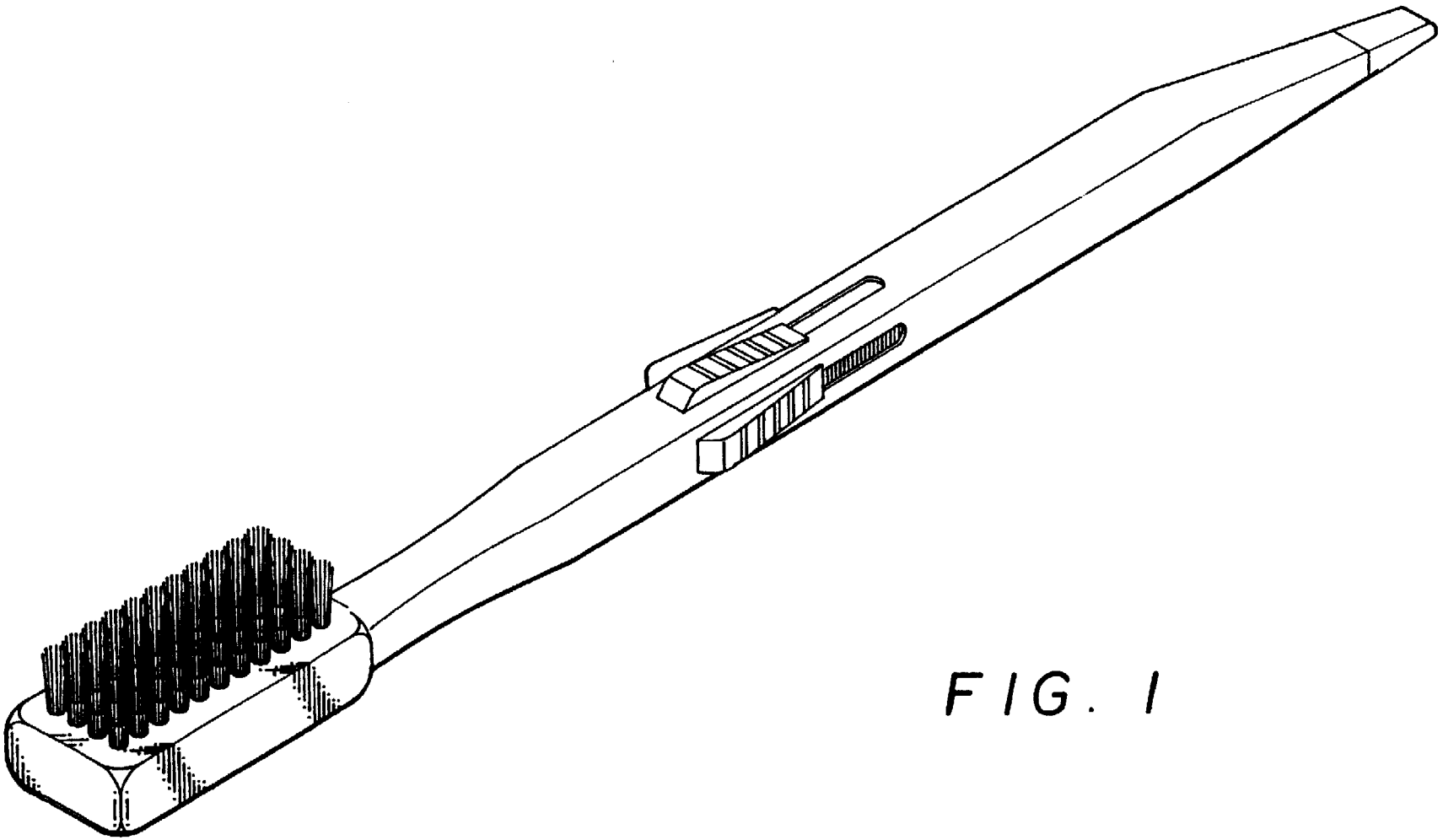
FIG. 1 is an elevational view of a toothbrush according to the present invention.
Figure 2:
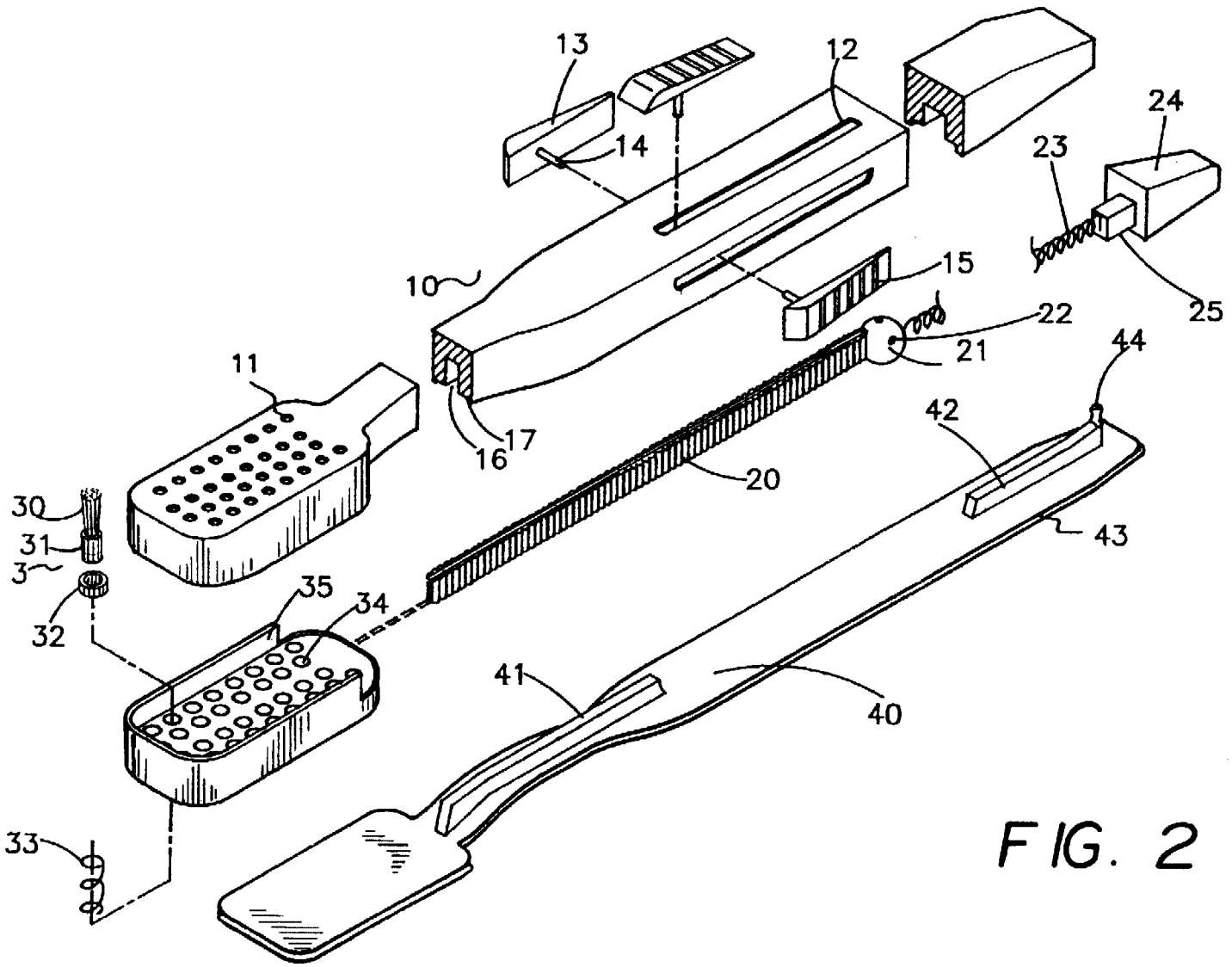
FIG. 2 is an exploded view of the toothbrush shown in FIG. 1.
Figure 3:
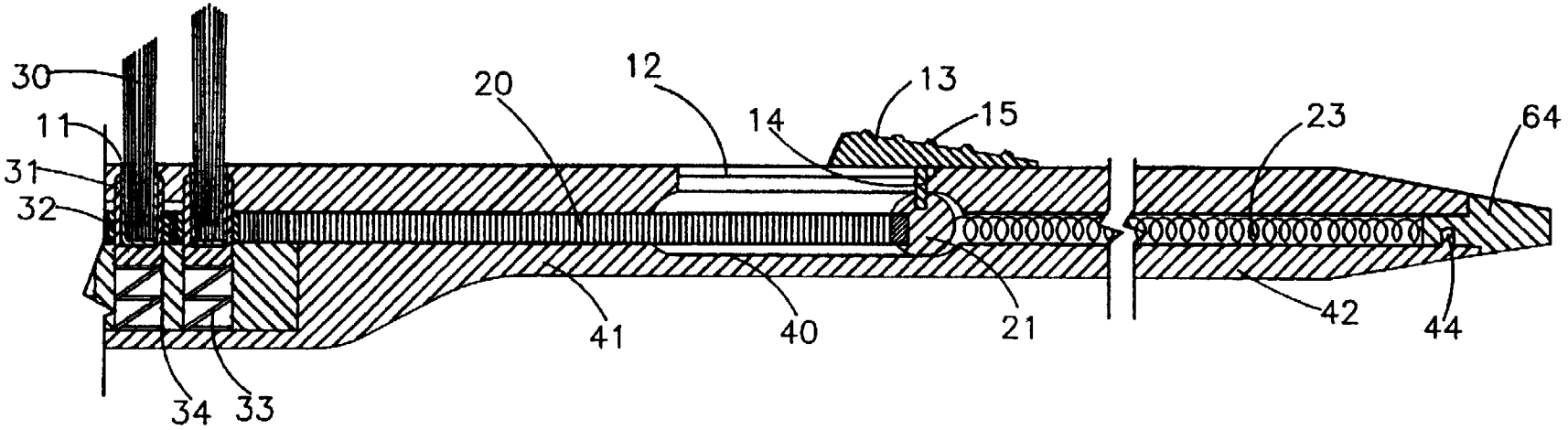
FIG. 3 is a side view in section of the toothbrush shown in FIG. 1.

Referring to FIGS. 1 and 2, a toothbrush in accordance with the present invention is generally comprised of a housing 10, a chain gearing 20, a bristle holder and carrier frame assembly 3, and a bottom cover 40.

Referring to FIG. 2 again, the chain gearing 20 is made by connecting a plurality of gears in series, having a ball 21 at one end, a spring 23, and an end member 24 connected to the ball 21 by the spring 23. The ball 21 has three pin holes 22 respectively disposed at two opposite lateral sides and the top side. The end member 24 has a pin hole 25 at the bottom side.

Referring to FIG. 2 again, the casing 10 has an elongated, substantially rectangular shape convenient for the holding of the hand, parallel rows of vertical bristle holes 11 at one end, three sliding slots 12 longitudinally disposed in the middle at two opposite lateral sides and the top, a longitudinal bottom track 16, and a longitudinally disposed recessed portion 17 at the bottom adapted for mounting the bottom cover 40. The rear half of the longitudinal bottom track 16 is disposed corresponding to the sliding slots 12, having a circular cross section within which the ball 21 is reciprocated. The front half of the longitudinal bottom track 6 has a rectangular cross section fitting the chain gearing 20. Three slides 13 are respectively and slidably mounted in the sliding slots 12. Each of the slides 13 has a bottom pin 14 inserted into one sliding slot 12 of the casing 10 and fitted into one pin hole 22 of the ball 21, and a plurality of transverse ribs 15 at the top through which the respective slide 13 can be positively moved with the fingers.

Figure 6:
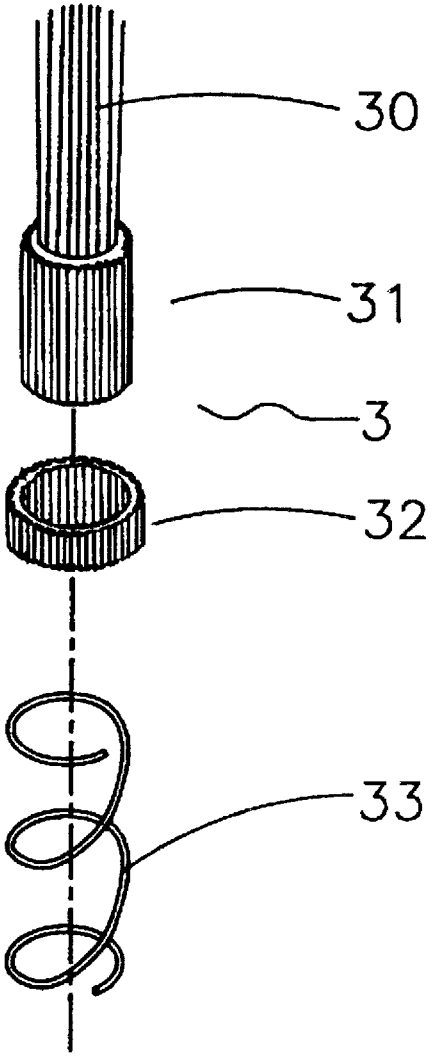
FIG. 6 is an exploded view of a part of the bristle holder and carrier frame assembly, showing the structure of the toothed socket and the bristle holder according to the present invention; and, FIG. 7 is an applied view of the present invention, showing the bundles of bristles moved against the teeth.

Referring to FIG. 6 and FIG. 2 again, the bristle holier and carrier frame assembly 3 comprises a hollow carrier frame 35 mounted within the casing 10 below the bristle holes 11 and having a plurality of locating holes 34 respectively disposed in vertical alignment with the bristle holes 11, a plurality of springs 33 respectively mounted in the locating holes 34 of the carrier frame 35, a plurality of toothed sockets 32 respectively mounted on the carrier frame 35 above the locating holes 34, a plurality of toothed bristle holders 31 respectively mounted in the toothed sockets 32 and connected to the springs 33 and holding a respective bundle of bristles 30 in the bristle holes 11 of the casing 10 and forced to move in and out of the locating holes 34. Each of the toothed sockets 32 has a longitudinally toothed outside wall disposed in engagement with chain gearing 20, and a longitudinally toothed inside wall meshed with the longitudinally toothed outside wall of one bristle holder 31.

Referring to FIG. 2 again, the bottom cover 40 is adapted for covering on the casing 10 at the bottom side to, hold the bristle holder and carrier frame assembly 3 and the chain gearing 20 inside the casing 10, having a longitudinal front rail 41 and a longitudinal rear rail 42 at the top, and a coupling flange 43 around the periphery adapted for coupling to the recessed coupling portion 17 of the casing 10. The longitudinal rear rail 42 has a rear end terminating into an upright pin 44 adapted for fitting into the pin hole 25 of the end member 24.

Referring to Figures from 3 to 5 and FIGS. 1 and 2 again, the bristle holder and carrier frame assembly 3 is fastened to one end of the chain gearing 20 remote from the ball 21, then the chain gearing 20 is mounted on the longitudinal front rail 41, and then the pin hole 25 of the end member 24 is coupled to the upright pin 44 of the longitudinal rear rail 42 of the bottom cover 40, permitting the spring 23 to be supported on the longitudinal rear rail 42, and then the slides 13 are respectively mounted on the casing 10 by inserting the respective bottom pins 14 through the longitudinal sliding slots 12 of the casing 10 and then respectively fitting them into the pin holes 22 of the ball 21, permitting the ball 21 to be disposed between the longitudinal front rail 41 and the longitudinal rear rail 42, and then the bottom cover 40 is covered on the casing 10 at the bottom side by fastening the coupling flange 43 of the bottom cover 40 to the recessed coupling portion 17 of the casing 10. When assembled, the bundles of bristles 30 of the bristle holder and carrier frame assembly 3 respectively protrude over the top side of the casing 10 through the bristle holes 11.

Figure 4:
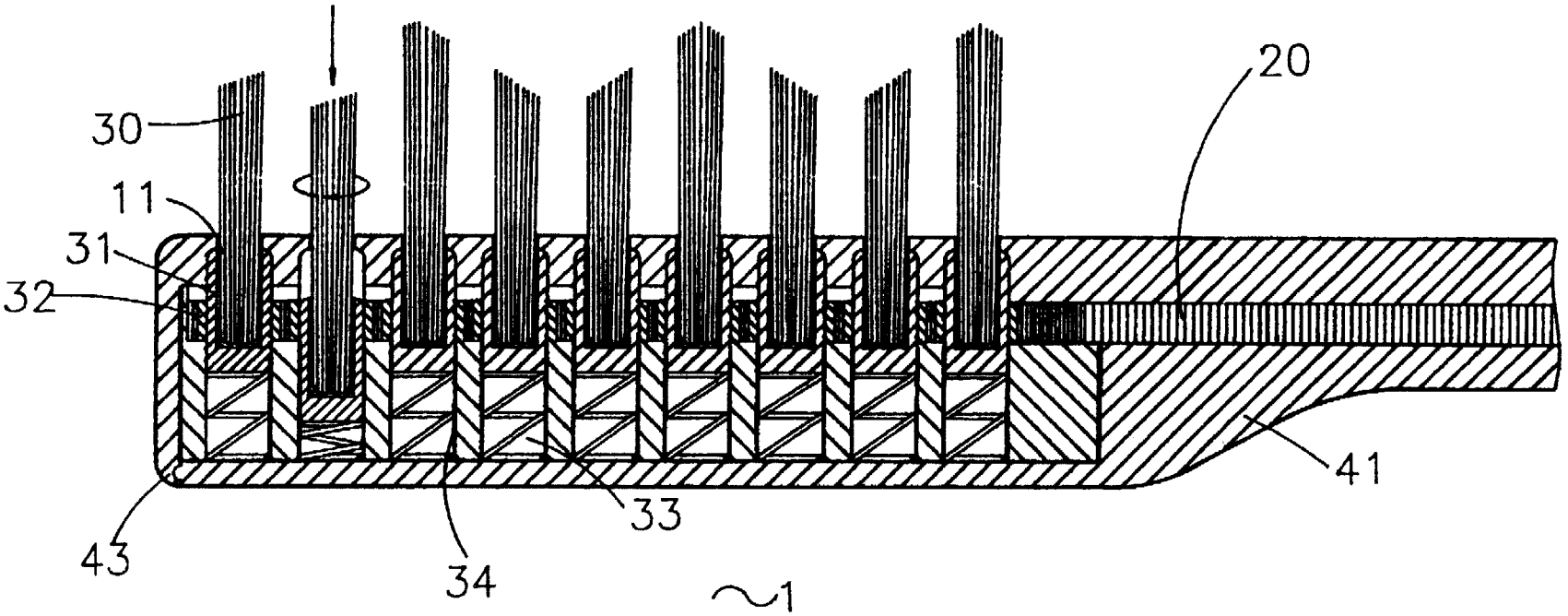
FIG. 4 is a sectional view of a part of the toothbrush shown in FIG. 1, showing the installation of the bristle holder and carrier frame assembly in the casing.
Figure 5:
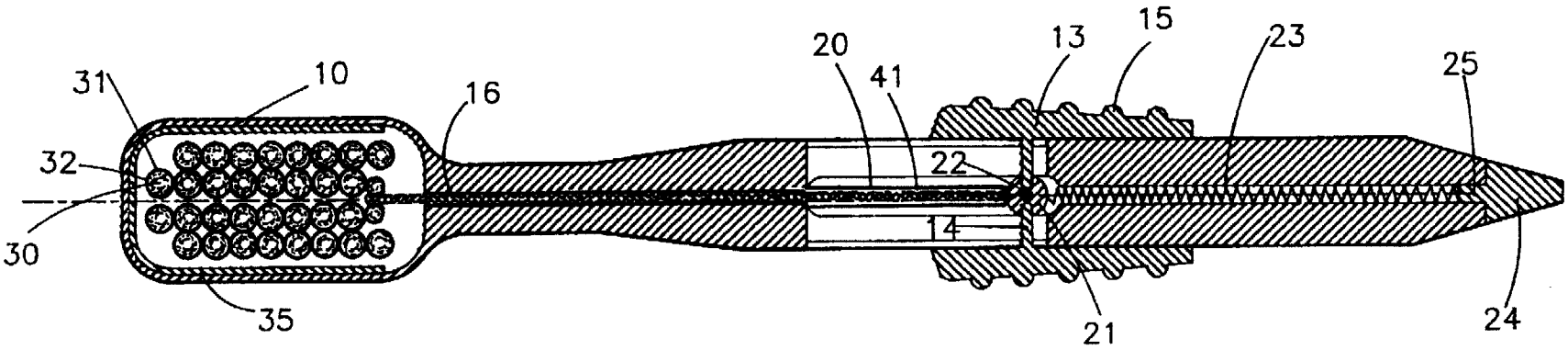
FIG. 5 is a top view in section of the toothbrush shown in FIG. 1.
Figure 7:
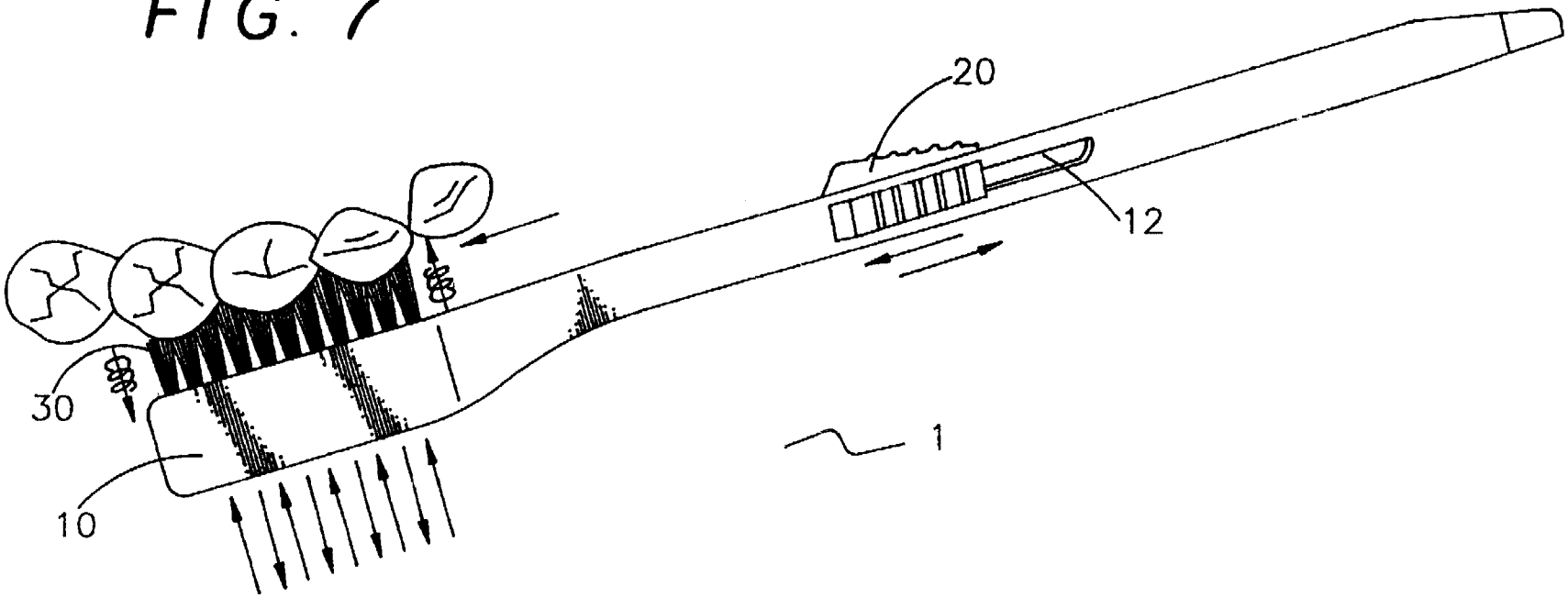

Referring to FIG. 7 and FIGS. 4 and 5 again, when the toothbrush is held in hand during brushing, the slides 13 are driven with fingers to be move the ball 21 between the longitudinal front rail 41 and the longitudinal rear rail 42, the toothed sockets 32 are moved by the chain gearing 20 to rotate clockwise and counter-clockwise. When the toothed sockets 32 are rotated, the bristle holders 31 are respectively turned with the toothed sockets 32. When the bundles of bristles 30 are pressed against the teeth, the bristle holders 31 are forced downwards to compress the springs 32. When the bundles of bristles 30 are released from the teeth, the springs 32 immediately force the bristle holders 31 back to their former positions.

While only one embodiment of the present invention has been shown and described, it will be understood that various modifications and changes could be made thereunto without departing from the spirit and scope of the invention disclosed.

I claim:

1. A toothbrush comprising:

an elongated, substantially rectangular casing having parallel rows of vertical bristle holes at one end, three sliding slots longitudinally disposed in the middle at two opposite lateral side and a top side thereof, a longitudinal bottom track and a longitudinally disposed recessed portion at a bottom open side thereof;

a bottom cover covered on the bottom open side of said casing, said bottom cover comprising a longitudinal front rail and a longitudinal rear rail disposed inside said casing, and an upright pin raised from said longitudinal rear rail at one end remote from said longitudinal front rail;

a bristle holder and carrier frame assembly mounted inside said casing below said bristle holes, said bristle holder and carrier frame assembly comprising a hollow carrier frame mounted within said casing below said bristle holes and having rows of locating holes respectively disposed in vertical alignment with the bristle holes of said casing, a plurality of springs respectively mounted in said locating holes of said carrier frame, a plurality of toothed socket respectively mounted above said locating holes below said bristle holes, a plurality of toothed bristle holders respectively mounted in said said toothed sockets and supported on the springs of said bristle holder and carrier frame assembly and holding a respective bundle of bristles in the bristle holes of said casing, said toothed bristle holders having a respective longitudinally toothed outside wall and being prohibited from rotary motion relative to said toothed socket, said bundle of bristles partially projecting out of said casing, each of said toothed sockets having a longitudinally toothed outside wall, and a longitudinally toothed inside wall engaged with the longitudinally toothed outside wall of one toothed bristle holder;

a. chain gearing mounted on the longitudinal front rail of said bottom cover, having one end meshed between the toothed sockets of said bristle holder and carrier frame assembly and an opposite end fixedly mounted with a ball, said ball having three pin holes, said chain gearing being reciprocated along the longitudinal front rail to turn the toothed sockets of said bristle holder and carrier frame assembly, causing said bristle holders to be turned back and forth;

an end member fastened to said bottom cover and connected to the ball of said chain gearing by a spring, said end member having a bottom pin hole coupled to the upright pin of the longitudinal rear rail of said bottom cover; and, three slides respectively moved along the sliding slots of said casing to move said chain gearing, each of said slides having a bottom pin inserted through one longitudinal slot of said casing and fitted into one pin hole of said ball.

* * * * *